US008148620B2

(12) United States Patent
Jones et al.

(10) Patent No.: US 8,148,620 B2
(45) Date of Patent: Apr. 3, 2012

(54) HAMMER STOPPERS AND USE THEREOF IN PIANOS PLAYABLE IN ACOUSTIC AND SILENT MODES

(75) Inventors: Scott Jones, Boalsburg, PA (US); James M. Lombino, Ashfield, MA (US); Susan Yake Kenagy, Dix Hills, NY (US); Sue Guan Lim, Flushing, NY (US)

(73) Assignee: Steinway Musical Instruments, Inc., Waltham, MA (US)

( * ) Notice: Subject to any disclaimer, the term of this patent is extended or adjusted under 35 U.S.C. 154(b) by 522 days.

(21) Appl. No.: 12/429,485

(22) Filed: Apr. 24, 2009

(65) Prior Publication Data

US 2010/0269665 A1 Oct. 28, 2010

(51) Int. Cl.
*G10D 13/02* (2006.01)

(52) U.S. Cl. ..... 84/423 R; 84/243

(58) Field of Classification Search ..... 84/236–238, 84/174, 243, 423 R

See application file for complete search history.

(56) References Cited

U.S. PATENT DOCUMENTS

| | | | |
|---|---|---|---|
| 527,533 | A | 10/1894 | McChesney et al. |
| 782,799 | A | 2/1905 | Smith |
| 3,545,329 | A | 12/1970 | Roehrig |
| 3,559,526 | A | 2/1971 | Raffali |
| 4,061,067 | A | 12/1977 | Carbone |
| 4,194,428 | A | 3/1980 | McFarlin |
| 4,203,341 | A | 5/1980 | Takahashi |
| 4,450,747 | A | 5/1984 | Aoyama |
| 4,679,477 | A | 7/1987 | Monte |
| 4,760,768 | A | 8/1988 | Yamamoto |
| 4,860,626 | A | 8/1989 | Tanaka et al. |
| 4,879,939 | A | 11/1989 | Wall |
| 4,901,614 | A | 2/1990 | Kumano et al. |
| 5,107,748 | A | 4/1992 | Muramatsu et al. |
| 5,125,309 | A | 6/1992 | Stanwood |
| 5,192,820 | A | 3/1993 | Kawamura et al. |
| 5,194,685 | A | 3/1993 | Kawamura et al. |
| 5,196,638 | A | 3/1993 | Hayashida et al. |
| 5,210,367 | A | 5/1993 | Taguchi et al. |
| 5,235,892 | A | 8/1993 | Terada et al. |

(Continued)

FOREIGN PATENT DOCUMENTS

DE 44 08 505 9/1995

(Continued)

OTHER PUBLICATIONS

European International Search Report and Written Opinion dated Oct. 13, 2008 in connection with International Application No. PCT/US2008.070045, 19 pages.

(Continued)

*Primary Examiner* — Kimberly Lockett
(74) *Attorney, Agent, or Firm* — Fish & Richardson P.C.

(57) ABSTRACT

A piano hammer stopper system includes a blocking rail movable between a first position, allowing unobstructed movement of piano hammers, and a second position, blocking at least one piano hammer from striking any corresponding strings. The piano hammer stopper system includes a drive shaft rotatably coupled to the blocking rail, a drive arm attached to the drive shaft and engaging a drive fulcrum, and a travel guide directing movement of the blocking rail between its first and second positions. Rotation of the drive shaft rotates the drive arm to engage the drive fulcrum for moving the blocking rail between its first and second positions.

23 Claims, 11 Drawing Sheets

U.S. PATENT DOCUMENTS

| | | | |
|---|---|---|---|
| 5,239,907 | A | 8/1993 | Sugiyama et al. |
| 5,272,950 | A | 12/1993 | Petersen |
| 5,286,915 | A | 2/1994 | Komano et al. |
| 5,353,671 | A | 10/1994 | Inoue et al. |
| 5,374,775 | A | 12/1994 | Kawamura et al. |
| 5,386,083 | A | 1/1995 | Kawamura |
| 5,410,937 | A | 5/1995 | Okamato et al. |
| 5,428,186 | A | 6/1995 | Kaneko et al. |
| 5,434,349 | A | 7/1995 | Kawamura |
| 5,444,181 | A | 8/1995 | Wada et al. |
| 5,451,706 | A | 9/1995 | Yamamoto et al. |
| 5,463,184 | A | 10/1995 | Kawamura |
| 5,483,861 | A | 1/1996 | Kawamura et al. |
| 5,506,369 | A | 4/1996 | Kawamura et al. |
| 5,509,340 | A | 4/1996 | Kawamura |
| 5,524,519 | A | 6/1996 | Matsunaga et al. |
| 5,528,969 | A | 6/1996 | Kihara et al. |
| 5,530,198 | A | 6/1996 | Ishii |
| 5,539,142 | A | 7/1996 | Emerson et al. |
| 5,541,353 | A | 7/1996 | Kawamura et al. |
| 5,542,328 | A | 8/1996 | Pimentel |
| 5,545,839 | A | 8/1996 | Kawamura et al. |
| 5,552,559 | A | 9/1996 | Sugiyama et al. |
| 5,552,560 | A | 9/1996 | Ura |
| 5,552,561 | A | 9/1996 | Nakada et al. |
| 5,557,052 | A | 9/1996 | Hayashida et al. |
| 5,565,636 | A | 10/1996 | Sugiyama |
| 5,567,902 | A | 10/1996 | Kimble et al. |
| 5,571,982 | A | 11/1996 | Masubuchi |
| 5,574,241 | A | 11/1996 | Kumano et al. |
| 5,583,306 | A | 12/1996 | Hayashida et al. |
| 5,583,310 | A | 12/1996 | Sugiyama et al. |
| 5,591,927 | A | 1/1997 | Kawamura et al. |
| 5,594,188 | A | 1/1997 | Kawamura et al. |
| 5,600,077 | A | 2/1997 | Honda |
| 5,602,351 | A | 2/1997 | Kawamura et al. |
| 5,608,175 | A | 3/1997 | Kawamura |
| 5,610,356 | A | 3/1997 | Koseki et al. |
| 5,612,502 | A | 3/1997 | Ura |
| 5,616,880 | A | 4/1997 | Hayashida et al. |
| 5,641,930 | A | 6/1997 | Nakada et al. |
| 5,646,359 | A | 7/1997 | Kihara et al. |
| 5,648,621 | A | 7/1997 | Sasaki |
| 5,652,399 | A | 7/1997 | Fujiwara et al. |
| 5,652,403 | A | 7/1997 | Sugiyama et al. |
| 5,663,513 | A | 9/1997 | Sugiyama et al. |
| 5,741,995 | A | 4/1998 | Kawamura et al. |
| 5,796,023 | A | 8/1998 | Kumano et al. |
| 5,804,816 | A | 9/1998 | Yamamoto et al. |
| 5,811,702 | A | 9/1998 | Tomizawa et al. |
| 5,821,443 | A | 10/1998 | Masubushi |
| 5,824,928 | A | 10/1998 | Kumano et al. |
| 5,824,930 | A | 10/1998 | Ura et al. |
| 5,834,668 | A | 11/1998 | Kumano et al. |
| 5,837,911 | A | 11/1998 | Inoue |
| 5,844,154 | A | 12/1998 | Kimble |
| 5,861,566 | A | 1/1999 | Kaneko et al. |
| 5,874,687 | A | 2/1999 | Kawamura |
| 5,880,389 | A | 3/1999 | Muramatsu |
| 5,880,393 | A | 3/1999 | Kaneko et al. |
| 5,895,875 | A | 4/1999 | Osuga et al. |
| 5,909,028 | A | 6/1999 | Yamamoto |
| 5,925,844 | A | 7/1999 | Inaba |
| 5,932,825 | A | 8/1999 | Kumano et al. |
| 5,942,702 | A | 8/1999 | Inoue |
| 5,942,705 | A | 8/1999 | Kumano et al. |
| 5,945,613 | A | 8/1999 | Kimble |
| 5,949,013 | A | 9/1999 | Satoshi |
| 5,977,466 | A | 11/1999 | Muramatsu |
| 5,994,632 | A | 11/1999 | Muramatsu et al. |
| 6,005,178 | A | 12/1999 | Osuga et al. |
| 6,011,214 | A | 1/2000 | Kawamura |
| 6,075,213 | A | 6/2000 | Ichiro |
| 6,084,167 | A | 7/2000 | Akimoto et al. |
| 6,147,289 | A | 11/2000 | Kumano |
| 6,194,649 | B1 | 2/2001 | Itou et al. |
| 6,199,649 | B1 | 3/2001 | Alanko |
| 6,229,081 | B1 | 5/2001 | Ura et al. |
| 6,245,985 | B1 | 6/2001 | Sasaki et al. |
| 6,265,647 | B1 | 7/2001 | Tamaki et al. |
| 6,271,447 | B1 | 8/2001 | Fujiwara et al. |
| 6,281,422 | B1 | 8/2001 | Kawamura |
| 6,288,313 | B1 | 9/2001 | Sato et al. |
| 6,297,437 | B1 | 10/2001 | Ura et al. |
| 6,359,207 | B1 | 3/2002 | Oba et al. |
| 6,362,412 | B1 | 3/2002 | Ura |
| 6,365,820 | B1 | 4/2002 | Kondo et al. |
| 6,376,759 | B1 | 4/2002 | Suzuki |
| 6,380,469 | B2 | 4/2002 | Uehara |
| 6,380,470 | B1 | 4/2002 | Fujiwara et al. |
| 6,380,472 | B1 | 4/2002 | Sugiyama et al. |
| 6,380,473 | B2 | 4/2002 | Uehara |
| 6,392,132 | B2 | 5/2002 | Uehara |
| 6,407,321 | B2 | 6/2002 | Tamaki et al. |
| 6,407,326 | B1 | 6/2002 | Kondo |
| 6,417,439 | B2 | 7/2002 | Uehara et al. |
| 6,417,440 | B2 | 7/2002 | Furuki |
| 6,420,642 | B1 | 7/2002 | Muramatsu et al. |
| 6,423,889 | B2 | 7/2002 | Inoue |
| 6,448,481 | B2 | 9/2002 | Maehara et al. |
| 6,452,079 | B2 | 9/2002 | Sugiyama et al. |
| 6,476,304 | B2 | 11/2002 | Uehara |
| 6,515,213 | B2 | 2/2003 | Muramatsu et al. |
| 6,528,713 | B2 | 3/2003 | Maehara |
| 6,552,251 | B2 | 4/2003 | Muramatsu et al. |
| 6,600,097 | B2 | 7/2003 | Shiiya |
| 6,649,821 | B2 | 11/2003 | Inoue |
| 6,660,917 | B2 | 12/2003 | Goto et al. |
| 6,670,532 | B2 | 12/2003 | Maehara |
| 6,683,242 | B2 | 1/2004 | Inoue et al. |
| 6,713,751 | B2 | 3/2004 | Muramatsu et al. |
| 6,730,839 | B2 | 5/2004 | Itou |
| 6,737,571 | B2 | 5/2004 | Furukawa |
| 6,765,142 | B2 | 7/2004 | Sakurada et al. |
| 6,815,603 | B2 | 11/2004 | Kato et al. |
| 6,864,412 | B2 | 3/2005 | Ichikawa |
| 6,867,359 | B2 | 3/2005 | Koseki et al. |
| 6,870,151 | B2 | 3/2005 | Kato |
| 6,933,435 | B2 | 8/2005 | Kato et al. |
| 6,933,494 | B2 | 8/2005 | Kato et al. |
| 6,940,005 | B2 | 9/2005 | Muramatsu et al. |
| 6,965,070 | B2 | 11/2005 | Wenjun |
| 6,969,791 | B2 | 11/2005 | Fujiwara |
| 6,992,241 | B2 | 1/2006 | Fujiwara |
| 6,992,242 | B2 | 1/2006 | Shirayanagi et al. |
| 6,995,308 | B2 | 2/2006 | Nishida et al. |
| 7,005,570 | B2 | 2/2006 | Nishitani |
| 7,009,095 | B2 | 3/2006 | Ichikawa et al. |
| 7,012,178 | B2 | 3/2006 | Muramatsu |
| 7,044,655 | B2 | 5/2006 | Kato et al. |
| 7,049,576 | B2 | 5/2006 | Kato et al. |
| 7,057,101 | B2 * | 6/2006 | Ishida ..... 84/236 |
| 7,094,961 | B2 | 8/2006 | Ura et al. |
| 7,121,737 | B2 | 10/2006 | Kato et al. |
| 7,132,643 | B2 | 11/2006 | Kato |
| 7,161,137 | B2 | 1/2007 | Ura et al. |
| 7,176,370 | B2 | 2/2007 | Osuga et al. |
| 7,179,974 | B2 | 2/2007 | Muramatsu |
| 7,186,967 | B2 | 3/2007 | Kato |
| 7,217,877 | B2 | 5/2007 | Funaki |
| 7,238,868 | B2 | 7/2007 | Muramatsu et al. |
| 7,259,313 | B2 | 8/2007 | Suzuki et al. |
| 7,265,281 | B2 | 9/2007 | Sasaki et al. |
| 7,268,289 | B2 | 9/2007 | Muramatsu et al. |
| 7,285,715 | B2 | 10/2007 | Sasaki et al. |
| 7,326,844 | B2 | 2/2008 | Nishida |
| 7,332,663 | B2 | 2/2008 | Nishida |
| 7,345,235 | B2 | 3/2008 | Izutani et al. |
| 7,355,109 | B2 | 4/2008 | Muramatsu et al. |
| 7,365,259 | B2 | 4/2008 | Nishida |
| 7,368,644 | B2 | 5/2008 | Shirayanagi et al. |
| 7,390,956 | B2 | 6/2008 | Fujiwara |
| 7,402,741 | B2 | 7/2008 | Funaki et al. |
| 7,405,350 | B2 | 7/2008 | Sasaki |
| 7,420,116 | B2 | 9/2008 | Fujiwara |
| 7,432,429 | B2 | 10/2008 | Muramatsu et al. |
| 7,432,430 | B2 | 10/2008 | Sasaki |

| | | | |
|---|---|---|---|
| 7,435,895 | B2 | 10/2008 | Muramatsu |
| 7,465,863 | B2 | 12/2008 | Nishida |
| 7,485,798 | B2 | 2/2009 | Nishida |
| 7,488,884 | B2 | 2/2009 | Ohno et al. |
| 7,488,885 | B2 | 2/2009 | Watanabe |
| 2001/0007219 | A1 | 7/2001 | Uehara et al. |
| 2001/0007220 | A1 | 7/2001 | Koseki et al. |
| 2001/0007221 | A1 | 7/2001 | Uehara |
| 2001/0035086 | A1 | 11/2001 | Sugiyama et al. |
| 2002/0059862 | A1 | 5/2002 | Muramatsu et al. |
| 2002/0062728 | A1 | 5/2002 | Muramatsu et al. |
| 2002/0194986 | A1 | 12/2002 | Kato et al. |
| 2003/0070526 | A1 | 4/2003 | Muramatsu et al. |
| 2003/0110897 | A1 | 6/2003 | Itou |
| 2004/0003708 | A1 | 1/2004 | Buchla |
| 2004/0025674 | A1 | 2/2004 | Muramatsu et al. |
| 2004/0168564 | A1 | 9/2004 | Koseki et al. |
| 2004/0221711 | A1 | 11/2004 | Kato et al. |
| 2005/0145087 | A1 | 7/2005 | Fujiwara |
| 2007/0000369 | A1 | 1/2007 | Okuyama |

FOREIGN PATENT DOCUMENTS

| | | | |
|---|---|---|---|
| DE | 195 27 270 | | 1/1997 |
| DE | 10 2005 017758 | | 8/2006 |
| EP | 0573963 | A2 | 12/1993 |
| EP | 0617403 | A2 | 9/1994 |
| EP | 0689183 | A | 12/1995 |
| JP | 63216099 | | 9/1988 |
| JP | 0174807 | | 6/1992 |
| JP | 06059667 | | 8/1994 |
| JP | 6289853 | | 10/1994 |
| JP | 191664 | A | 7/1995 |
| JP | 07210150 | | 8/1995 |
| JP | 07271347 | A | 10/1995 |
| JP | 8036380 | | 2/1996 |
| JP | 8063149 | A | 3/1996 |
| JP | 8123403 | | 5/1996 |
| JP | 2737590 | | 1/1998 |
| JP | 2901864 | | 3/1999 |
| JP | 200322052 | | 11/2000 |
| JP | 3203784 | | 6/2001 |
| JP | 3279307 | | 2/2002 |
| JP | 3292164 | | 3/2002 |
| JP | 3364354 | | 10/2002 |
| JP | 3360390 | B2 | 12/2002 |
| JP | 2003-084753 | | 3/2003 |
| JP | 3438308 | B2 | 8/2003 |
| JP | 3456243 | | 8/2003 |
| JP | 2003066947 | | 8/2003 |
| JP | 3485966 | | 10/2003 |
| JP | 2004094277 | | 3/2004 |
| JP | 3569660 | | 6/2004 |
| JP | 3714349 | | 2/2005 |
| JP | 2005134926 | | 5/2005 |
| JP | 3693047 | | 7/2005 |
| JP | 2005258461 | | 9/2005 |
| JP | 3873522 | | 2/2006 |
| JP | 3823999 | | 7/2006 |
| JP | 3832500 | | 7/2006 |
| JP | 3861906 | | 10/2006 |
| WO | WO 00/70600 | | 11/2000 |
| WO | WO 2009/017961 | | 2/2009 |

OTHER PUBLICATIONS

International Search Report and Written Opinion in connection with International Application No. PCT/US2009/032097, dated Jul. 16, 2009.

International Search Report and Written Opinion in connection with International Application No. PCT/US2009/043767, dated Aug. 11, 2009.

* cited by examiner

HAMMER STOPPERS AND USE THEREOF IN PIANOS PLAYABLE IN ACOUSTIC AND SILENT MODES

TECHNICAL FIELD

This disclosure relates to hammer stoppers and use thereof in pianos playable in both acoustic and silent modes.

BACKGROUND

An acoustic piano employs distinct and separate systems to transfer energy from a finger or actuator input force into an auditory, vibrational force. The transmission system, commonly called the action, is a network of levers, cushions and hammers that accepts finger/actuator input force through a collection of pivotal levers, known as keys. The keys and action focus this input force into rotating hammers of proportional density that are positioned to strike against tensioned wire strings. Both hammers and their corresponding strings are carefully constructed to match their acoustic properties, resulting in a tapered or graduated "scale" of components that cumulatively produce a multiple note span of musical frequencies. The strings act as media through which vibrational energy is transferred into an amplifier such as a soundboard, or electric speaker, where it ultimately is converted into audible sound.

Pianos can produce a wide range of volume. Large pianos can further expand this range to include very loud sounds, as heard in concert pianos that are expected to broadcast over an orchestra without the assistance of electric amplification. Pianos are prevalent in many cultures worldwide. They are present in many households, schools, institutions, etc. Inevitably, this proximity of volume producing instruments creates situations where sound control and reduction are necessary. Many piano manufacturers have provided muting mechanisms within their pianos to selectively restrict volume level. These mechanisms typically include a rotating rail that inserts an impact-absorbing material of varying density between the hammers and strings.

SUMMARY

In one aspect, a piano hammer stopper system includes a blocking rail movable between a first position, allowing unobstructed movement of piano hammers, and a second position blocking at least one piano hammer from striking any corresponding strings. The piano hammer stopper system includes a drive shaft rotatably coupled to the blocking rail, a drive arm attached to the drive shaft and engaging a drive fulcrum, and a travel guide directing movement of the blocking rail between its first and second positions. Rotation of the drive shaft rotates the drive arm to engage the drive fulcrum for moving the blocking rail between its first and second positions.

Implementations of this aspect of the disclosure may include one or more of the following features. In some implementations, the drive arm defines a slot configured to receive the drive fulcrum with the drive arm pivoting about and sliding with respect to the received drive fulcrum. In other implementations, the drive arm includes first and second portions slidably engaging one another. The first drive arm portion is attached to the blocking rail and the second drive arm portion is pivotally coupled to the drive fulcrum. The travel guide may include a guide shaft received by a guide way, and the guide shaft is attached to at least one of the blocking rail and a support member of the hammer stopper system. In some examples, the travel guide defines a guide way configured to receive the drive shaft (e.g., to direct movement of the drive shaft and associated blocking rail between its first and second positions). The blocking rail may be biased (e.g., by a spring) toward one of its first and second positions.

In some implementations, the drive shaft is flexible for following the general shape of the blocking rail, which allows the drive shaft to follow along a non-linear blocking rail. A shaft rotator may be coupled to the drive shaft for rotating the drive shaft. The shaft rotator may include a lever defining an aperture for a receiving a pivot. Rotation of the lever about the pivot moves the drive shaft vertically with respect to the pivot and rotates the drive shaft with respect to the blocking rail. In some examples, an arm rotator is coupled to the drive arm for pivoting the drive arm with respect to the drive fulcrum.

In another aspect, a piano playable in an acoustic mode and a silent mode includes a series of keys, a series of key actions, each key action actuated by depression of a corresponding key, and a series of rotatable hammers, each defining a forward throw direction and having at least one corresponding string, the hammers being driven by corresponding key actions transferring forces from corresponding keys. The piano also includes a hammer stopper system that includes a blocking rail movable between a first position, allowing unobstructed movement of piano hammers, and a second position blocking at least one piano hammer from striking any corresponding strings. The hammer stopper system includes a drive shaft rotatably coupled to the blocking rail, a drive arm attached to the drive shaft and engaging a drive fulcrum, and a travel guide directing movement of the blocking rail between its first and second positions. Rotation of the drive shaft rotates the drive arm to engage the drive fulcrum for moving the blocking rail between its first and second positions.

Implementations of this aspect of the disclosure may include one or more of the following features. In some implementations, the drive arm defines a slot configured to receive the drive fulcrum, with the drive arm pivoting about and sliding with respect to the received drive fulcrum. In other implementations, the drive arm includes first and second portions slidably engaging one another. The first drive arm portion is attached to the blocking rail and the second drive arm portion is pivotally coupled to the drive fulcrum.

The travel guide may include a guide shaft received by a guide way, with the guide shaft attached to the blocking rail and at least one support member of the hammer stopper system. In some examples, the travel guide defines a guide way configured to receive the drive shaft (e.g., to direct movement of the drive shaft and associated blocking rail between its first and second positions). The blocking rail may be biased (e.g., by a spring) toward one of its first and second positions.

In some implementations, the drive shaft is flexible for following the general shape of the blocking rail, which allows the drive shaft to follow along a non-linear blocking rail. A shaft rotator may be coupled to the drive shaft for rotating the drive shaft. The shaft rotator may include a lever defining an aperture for a receiving a pivot. Rotation of the lever about the pivot moves the drive shaft vertically with respect to the pivot and rotates the drive shaft with respect to the blocking rail. In some examples, an arm rotator is coupled to the drive arm for pivoting the drive arm with respect to the drive fulcrum.

The piano may include a mode selection switch in communication with the rail actuator assembly and controlling movement of the blocking rail among the first and second positions. In some examples, a pedal of the piano engages the mode selection switch. The piano may include a controller in communication with the rail actuator assembly and controlling switching among the acoustic play mode and the silent play mode.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

The present disclosure provides a hammer stopper system that may be incorporated in horizontal (grand) and upright pianos. In some configurations, as described below, the hammer stopper system can be retrofit into existing pianos, and/or removed, e.g., for ease of maintenance.

Figure 1:
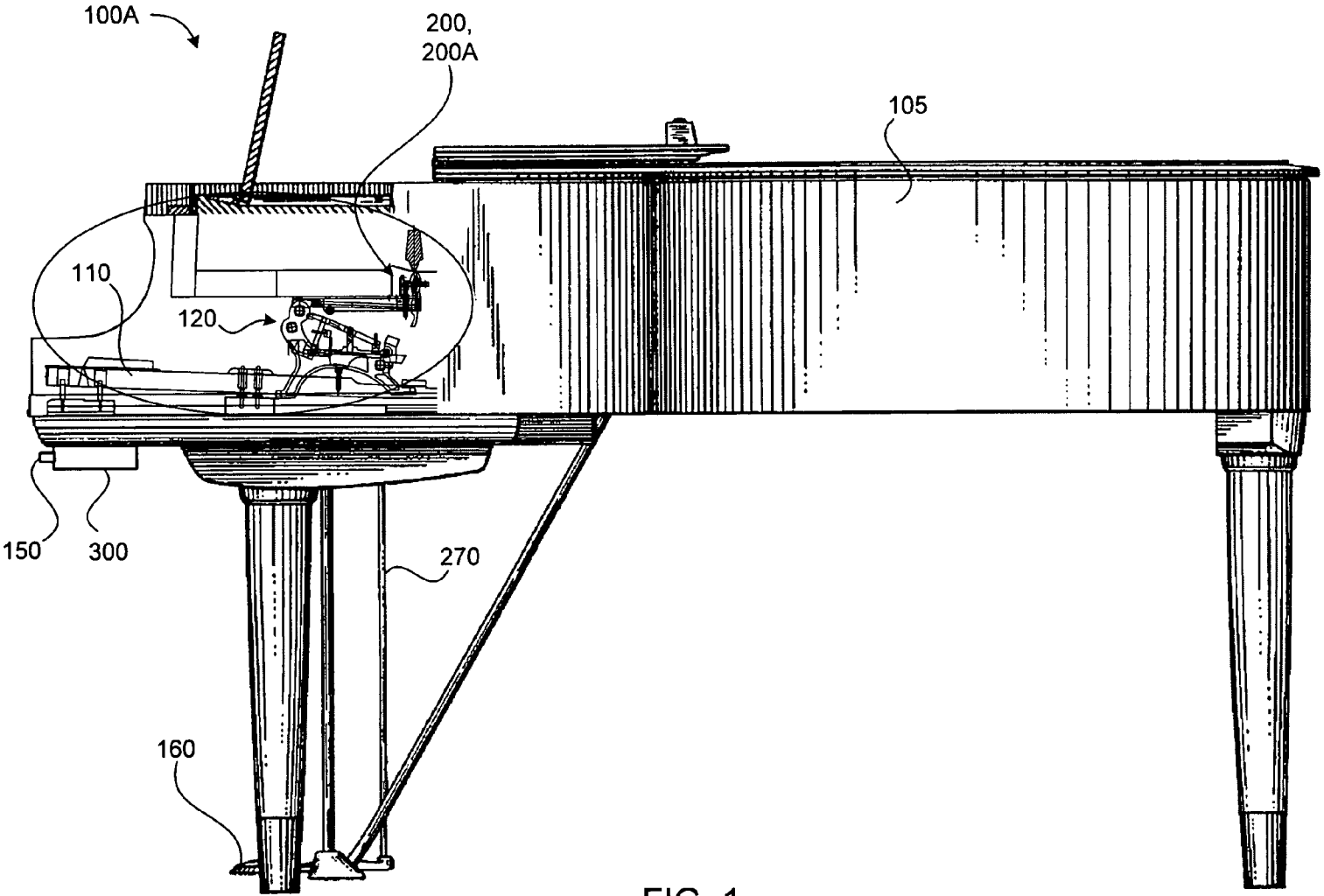
FIG. 1 is a side view of a horizontal (grand) piano with a hammer stopper system.
Figure 2:
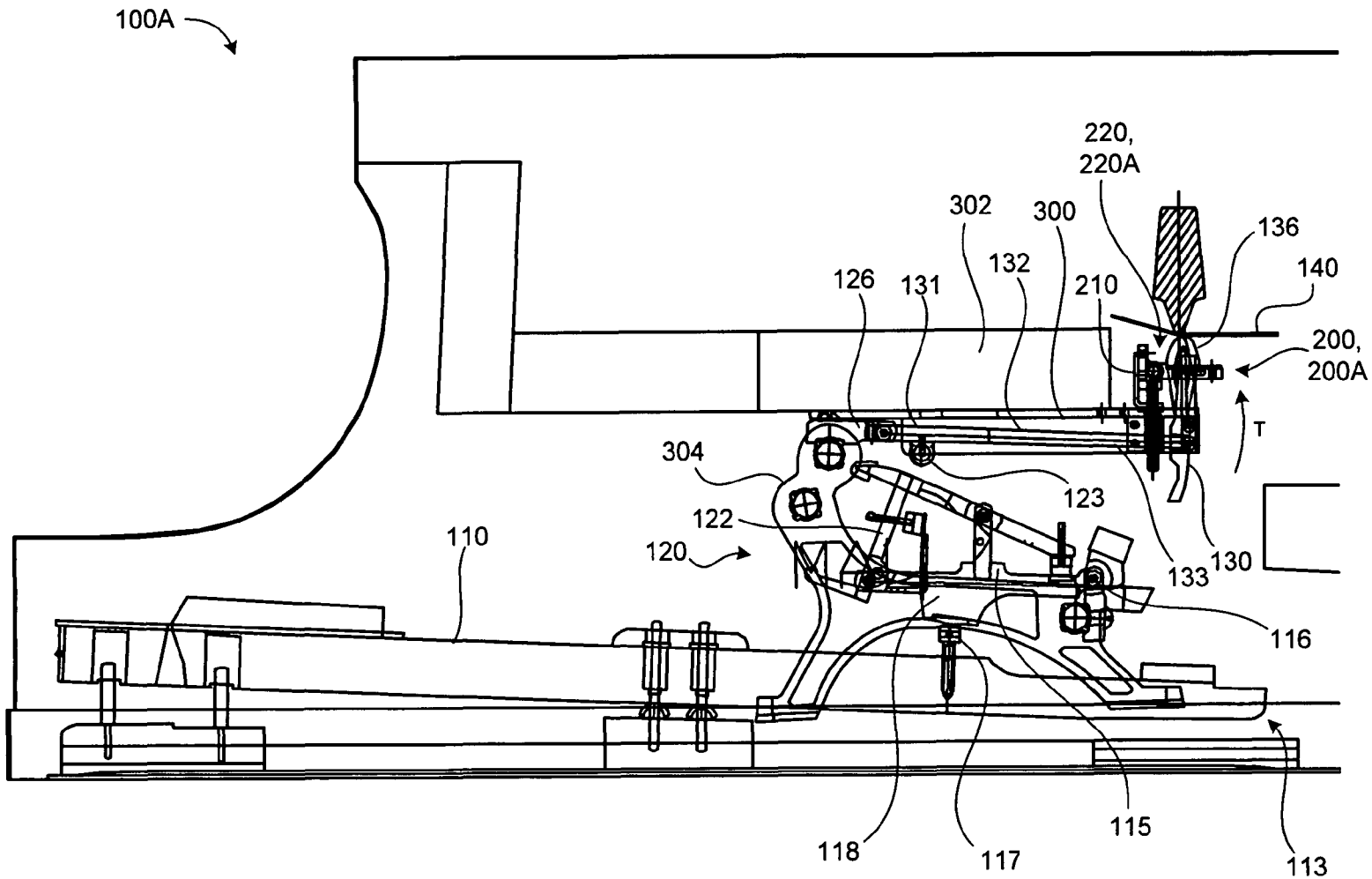
FIG. 2 is a side view of a grand piano action with a hammer stopper system.
Figure 3:
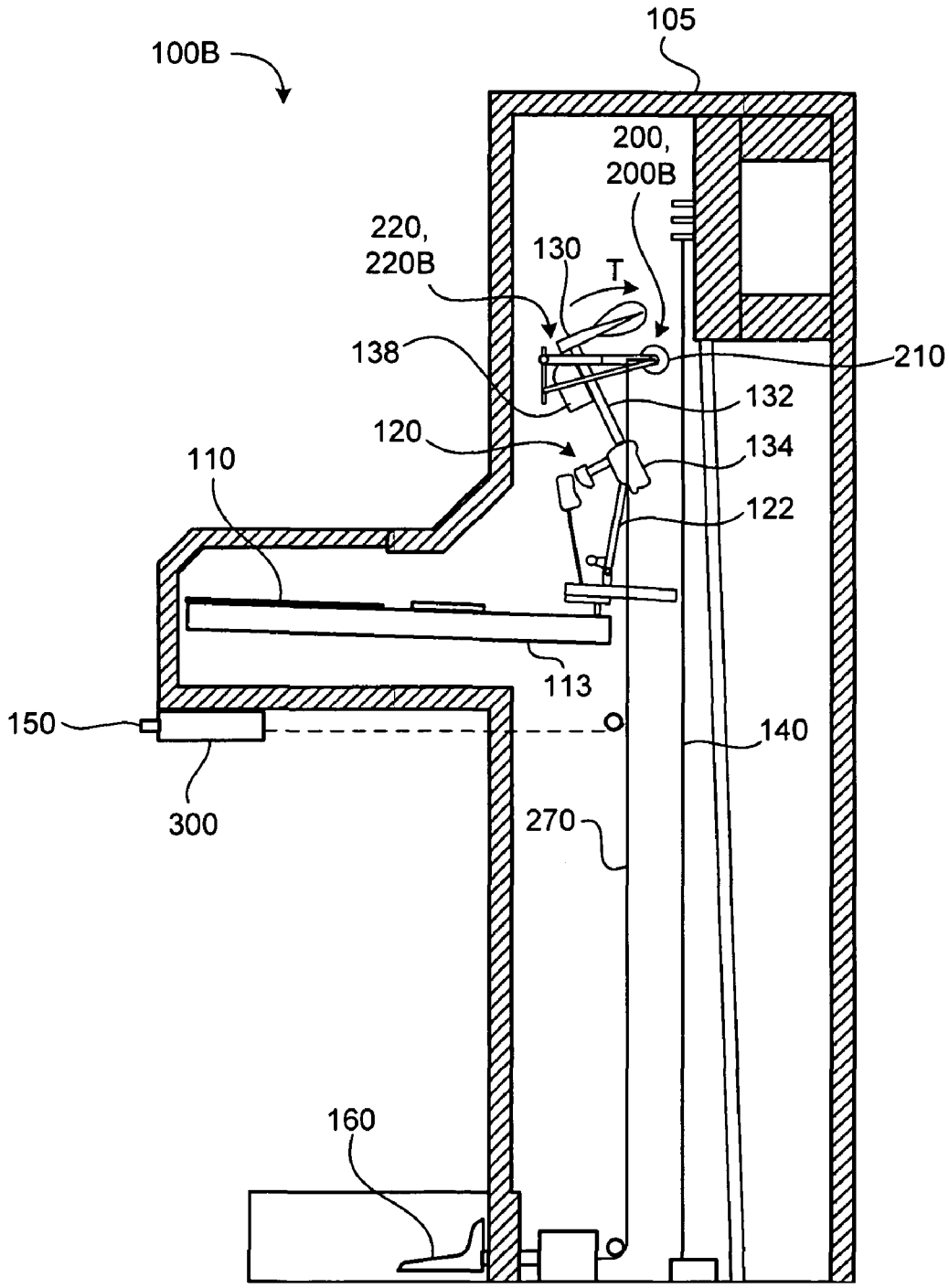
FIG. 3 is a side view of an upright piano with a hammer stopper system.

Referring to FIGS. 1-3, a piano 100, playable selectively in an acoustic mode and a silent mode, includes a series of keys 110 and corresponding key actions 120 linked to rear ends 113 of the keys 110. Each key action 120 is actuated by depressing a corresponding key 110. A series of rotatable hammers 130, each defining a forward throw direction, T, are driven by corresponding key actions 120, which transfer forces from corresponding pressed keys 110. Each hammer 130 is aligned to strike a corresponding string 140 or group of strings 140, upon being thrown. For example, the hammer 130 may strike between one and three strings 140 to provide the desired note of the corresponding depressed key 110. For note 1 to notes 8, 10 or 12, depending on the piano size, the strings 140 per hammer 130 may be unichords, meaning one string per note. For approximately note 11 to note 20 or 30 or any note therebetween, depending on the piano scale, the strings 140 per hammer 130 may be bichords, meaning two strings 140 per note. For note 20 or 30 through to note 88, depending on the piano scale, the strings 140 per hammer 130 may be trichords, meaning three strings 140 per note. As such, when referring to a string 140, as in a corresponding string 140 of a hammer 130, it may include a group or set of strings 140 (e.g., one or more strings 140).

Referring to FIGS. 1 and 2, in an exemplary horizontal (e.g., grand) piano 100A, each key 110 is supported at a fulcrum 112, and the rear end 113 of each key 110 may support a backcheck (not shown). A wippen lever 115 is pivotally connect to a structural assembly of the piano 110A for pivoting about pivot 116. A jack 122 is pivotally connected to the wippen lever 115. An adjustable capstan 117 attached to the key 110, contacts a wippen butt 118 on the wippen lever 115 and raises the wippen lever 115 when the key 110 is depressed. The raised wippen lever 115 causes the jack 122, in contact with a hammer knuckle 123, pivots an associated hammer 130, which is pivotally connected to a hammer flange 126. Further motion of the wippen lever 115 causes the jack 122 to move out of contact with the hammer knuckle 123, i.e. disengage, as the hammer 130 is thrown along a throw direction T for striking a corresponding string(s) 140.

Referring to FIG. 3, in an exemplary upright piano 100B, each hammer 130 includes a hammer shank 132, a butt 134 attached to a first end 131 of the shank 132, and a hammer head 136 attached to an opposite, second end 133 of the shank 132. A depressed or actuated key 110 causes a jack 122 of the associated key action 120 to kick the butt 134 of the hammer 130. When the jack 122 kicks the butt 134, the butt 134 and the hammer shank 132 are driven for rotation toward the associated strings 140. The hammer head 136 strikes the string(s) 140, producing an acoustic sound. When the keys 110 are in a rest position (e.g. when a player is not pressing the keys 110), the hammers 130 remain in home positions, resting on a hammer resting rail 138 and/or the jack 122.

Figure 5:
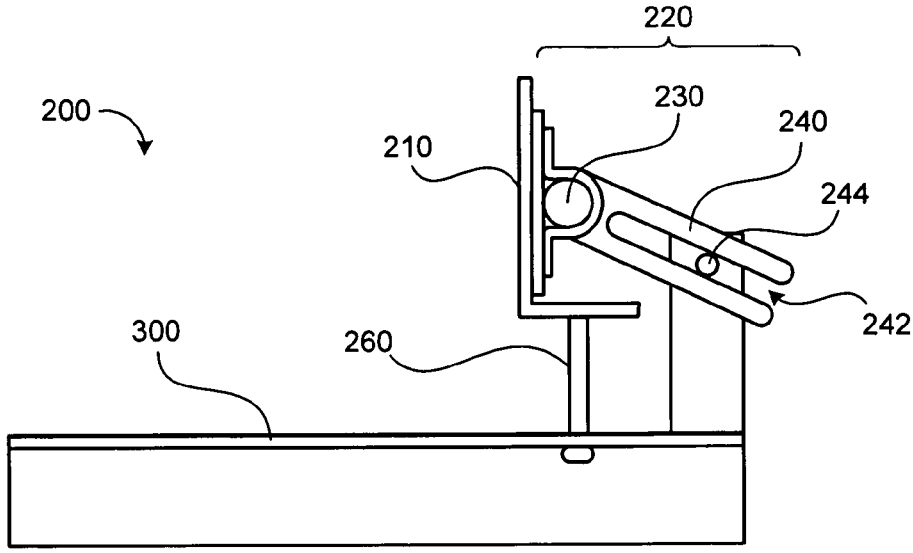
FIG. 5 is a side view of a hammer stopper system in an acoustical mode/non-blocking position.
Figure 6:
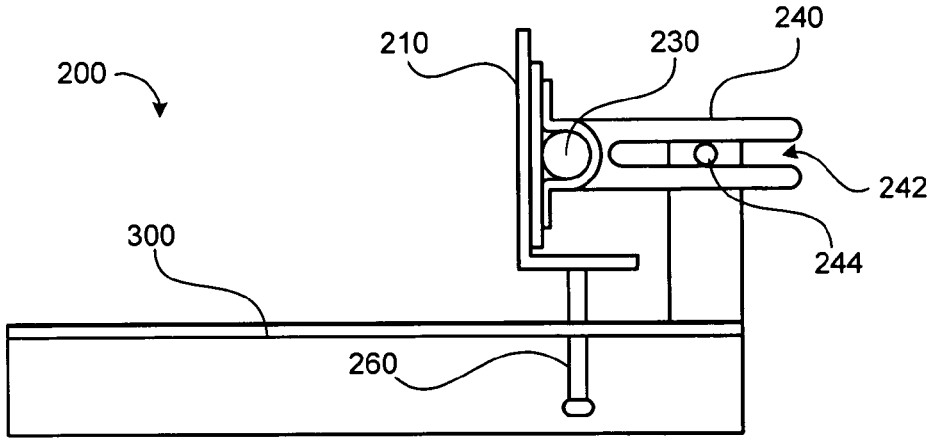
FIG. 6 is a side view of a hammer stopper system in an intermediate position
Figure 7:
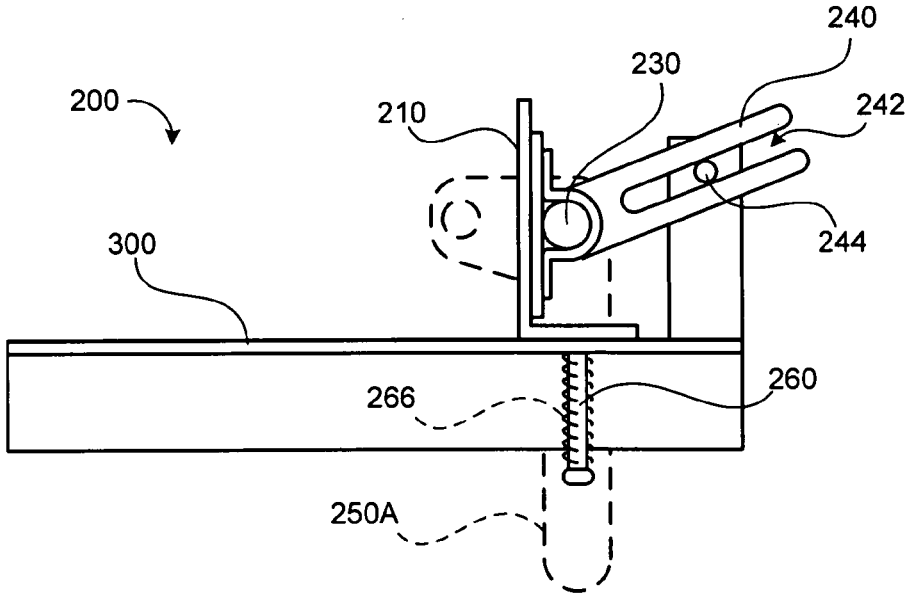
FIG. 7 is a side view of a hammer stopper system in a silent mode/blocking position
Figure 8:
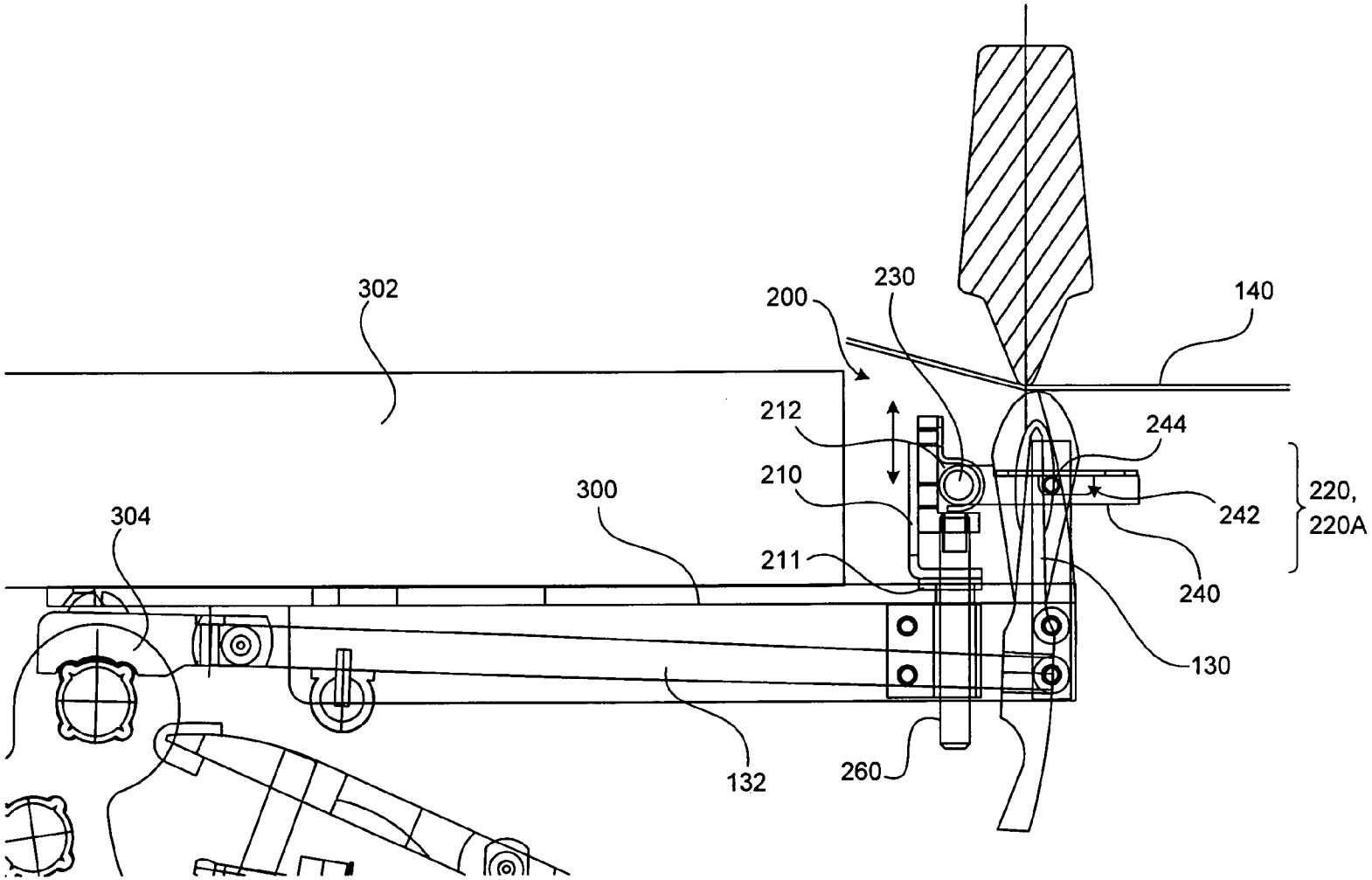
FIG. 8 is a side view of a hammer stopper system in an acoustical mode/non-blocking position.
Figure 9:
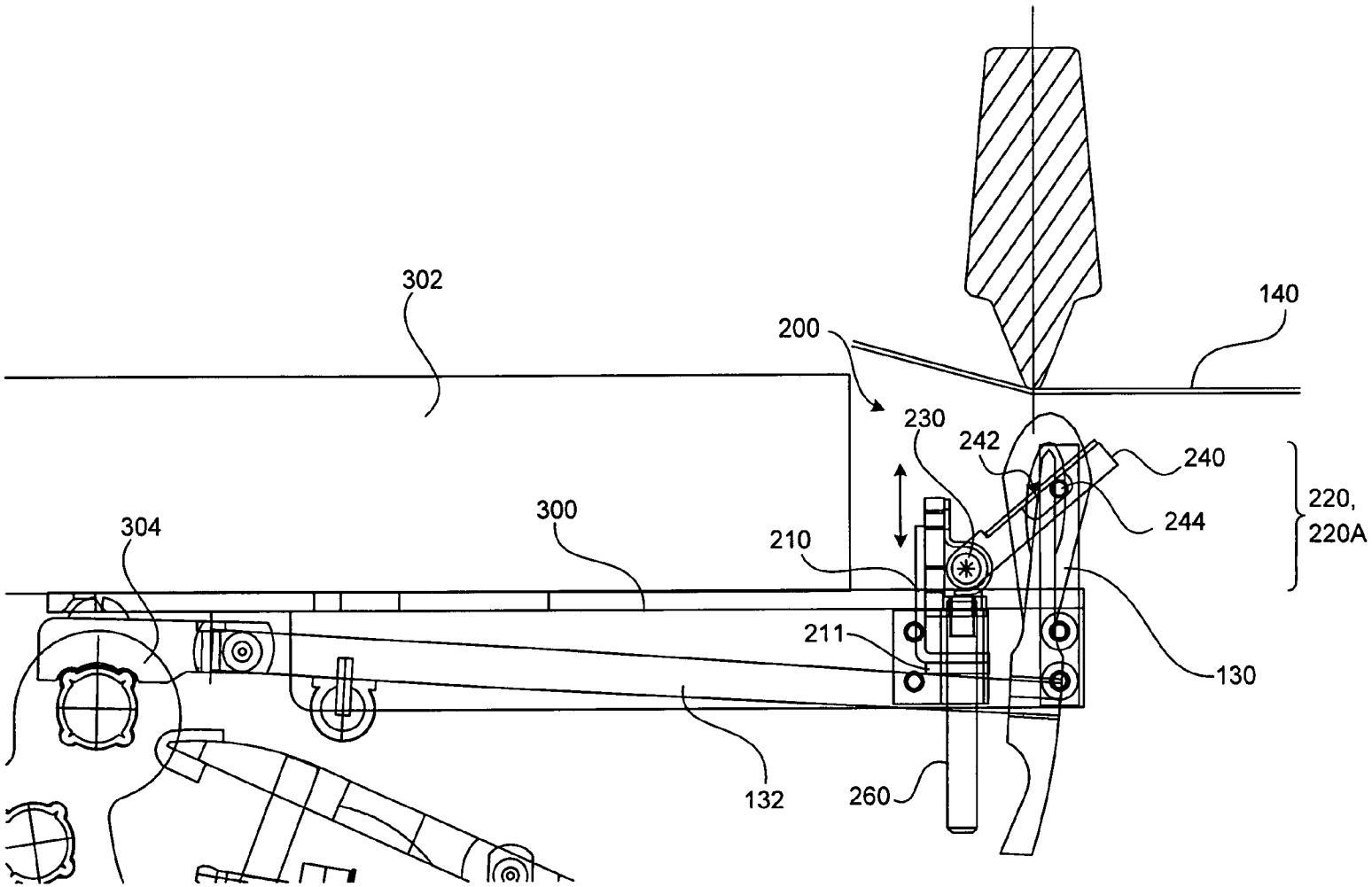
FIG. 9 is a side view of a hammer stopper system in a silent mode/blocking position.

Referring to FIGS. 2 and 3, a hammer stopper system 200 includes a blocking rail 210 disposed between the hammers 130 and the strings 140, and a rail actuator assembly 220 configured to move the blocking rail 210 between a first position, allowing unobstructed movement of the hammers 130, and a second position blocking at least one hammer 130 from striking its corresponding string(s) 140. The rail actuator assembly 220 moves the blocking rail 210 to the first position (FIGS. 5 and 8) for acoustic play and to the second position (FIGS. 7 and 9) for silent play. In some implementations, as with grand pianos 100A (FIG. 2), the hammer stopper system 200, 200A is disposed substantially between the hammers 130 and strings 140. In other implementations, as with upright pianos 100B (FIG. 3), portions of the hammer stopper system 200, 200B are disposed on both sides of the hammers 130 with respect to the strings 140.

FIGS. 2-11 illustrate implementations of the hammer stopper system 200, 200A for a grand piano 100A; however, the hammer stopper system 200A may also be implemented in a similar manner in an upright piano 1008. The hammer stopper system 200A includes a rail actuator assembly 220A includes a drive shaft 230 disposed along the blocking rail 210. The drive shaft 230 rotates with respect to the blocking rail 210 and may be a rigid shaft (e.g., bar stock) or a flexible shaft, which transmits rotation and torque while remaining flexible to bend along any curves of the blocking rail 210. In some examples, the drive shaft 230 is routed through or along a channel 212 (FIG. 8) defined by the blocking rail 210. The channel 212 may be an open or enclosed channel or throughway. The rail actuator assembly 220 includes at least one drive arm assembly 225 disposed along the drive shaft 230. The blocking rail 210 may have a break in continuity, flex joint, or other device for allowing flexing of the blocking rail at the drive arm assembly 225. The drive arm assembly 225 includes a drive arm 240 attached to the drive shaft 230 and slidably coupled to a support member 300, which may be attached to a pin block 302 or an action bracket 304. Rotation of the drive shaft 210 causes rotation of the drive arm 240, which engages a drive arm fulcrum 244 to move the blocking rail 210 between its first and second positions. The drive arm fulcrum 244 may be disposed on a support member 300 (e.g., bracket). The support member 300 may be attached to a pin block 302 or an action bracket 304. The rail actuator assembly 220A includes one or more travel guides 260 configured to guide movement of the blocking rail 210 along a travel path among its first and second positions. In the example shown, the travel path is a substantially linear path, while in other implementations, the travel path may be parabolic or non-linear. The blocking rail 210 may include a hammer cushion 211 (FIG. 8) positioned to receive and absorb the impact of a thrown hammer 130.

Figure 4:
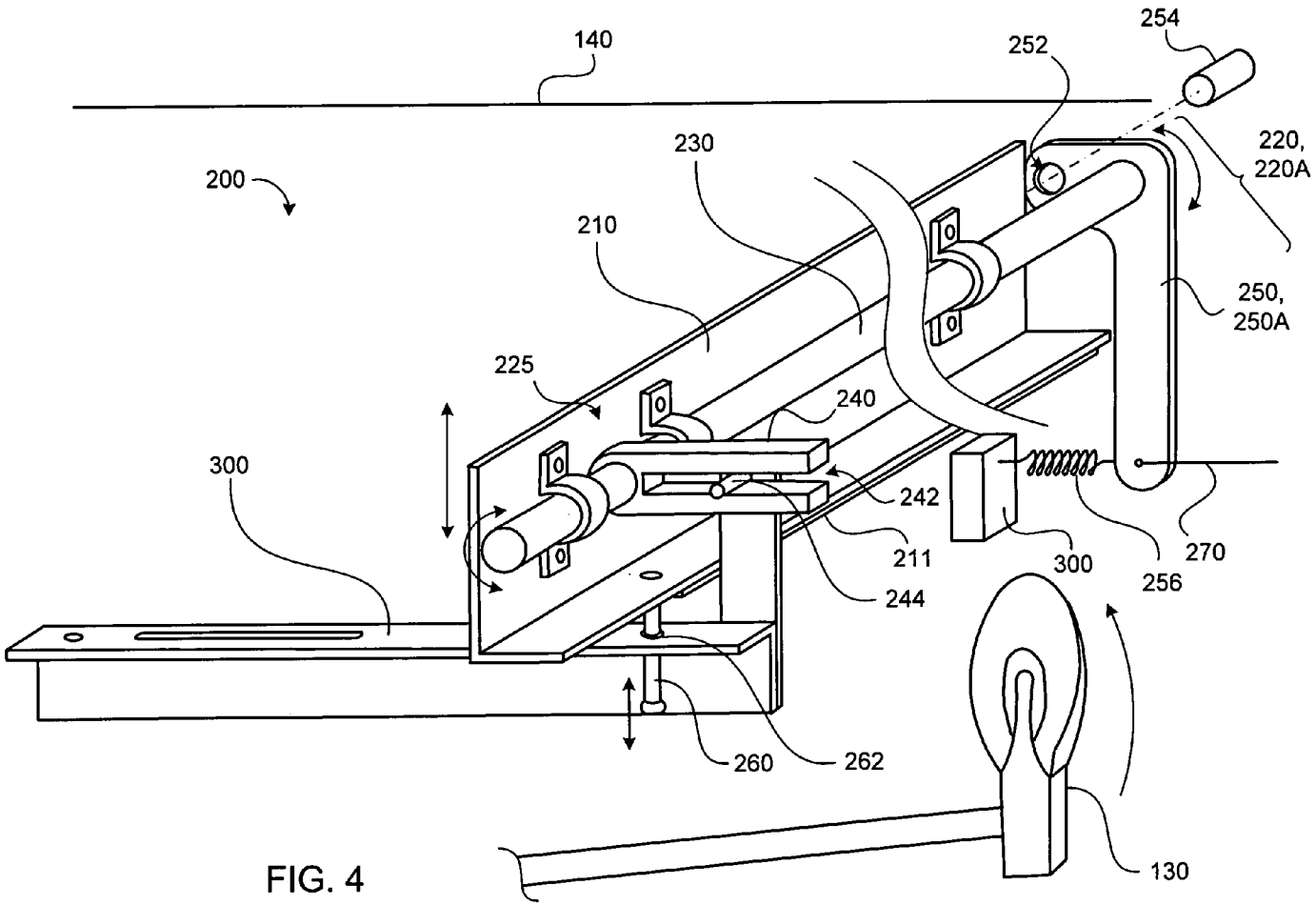
FIG. 4 is a perspective view of a hammer stopper system for a grand piano.

Referring to FIG. 4, the rail actuator assembly 220A includes a shaft rotator 250 coupled to the drive shaft 230 for rotating the drive shaft 230 and the attached drive arm(s) 240 between first and second positions for moving the blocking rail 210 between its corresponding first and second positions. Examples of the shaft rotator 250 include a lever 250A coupled to the drive shaft 230 and pivoted by an attached wire 270 or linkage, a rotary actuator (e.g., rotary motor) (not shown) coupled to the drive shaft 230, or a linear actuator, such as a solenoid. In examples using the lever 250A, the wire or linkage 270 may be coupled to a mode selection switch 150 (e.g., FIG. 13) or pedal 160 (e.g., FIG. 1) of the piano 100. In the example shown in FIG. 4, the lever 250A is attached to the drive shaft 230 for transferring rotation to the drive shaft 230. The lever 250A defines an aperture 252 for receiving a pivot 254 about which the lever 250A rotates. The pivot 254 may be attached to or defined by a portion of the piano case 105, a plate horn of the piano 100A, or a support member 300, which may be attached to the pin block 302 or an action bracket 304. A spring 256 may bias the lever 250A to rotate the drive shaft 230 and move the blocking rail 210 toward one of its first or second positions. The spring 256 may be attached to a portion of the piano case 105, a plate horn of the piano 100A, or a support member 300, which may be attached to the pin block 302 or an action bracket 304. Actuation of the attached wire 270 (e.g., by the mode selection switch 150A (FIG. 13)) moves the lever 250A for actuating the rail actuator assembly 220A. Rotation of the lever 250A about its pivot 254 moves the drive shaft 230 vertically along an arcuate path with respect to the pivot 254 and rotates the drive shaft 230 with respect to the blocking rail 210. The vertical movement of the drive shaft 230 with respect to the pivot 254 by the lever 250A moves the blocking rail 210 between its first and second positions at the lever 250A. The rotation of the drive shaft 230 by the lever 250A causes rotation of each drive arm assembly 225 to engage its corresponding drive arm fulcrum 244 to move the blocking rail 210 between its first and second positions at each drive arm assembly 225. Each travel guide 260 maintains a vertical orientation of the blocking rail 210, thus preventing rotation of the blocking rail 210 about its longitudinal axis, as it moves vertically between its first and second positions.

In some implementations, the hammer stopper system 200A is installed in a bass section of the piano 100A (e.g., approximately between notes 1 and 21) and also separately installed in a treble section of the piano 100A (e.g., approximately between notes 21 and 88). The hammer stopper system 200A in the bass section of the piano 100A may include one drive arm assembly 225 substantially near note 1 and the shaft rotator 250 (e.g., lever arm 250A) substantially near note 21. The hammer stopper system 200A in the treble section of the piano 100A may include the shaft rotator 250 (e.g., lever arm 250A) substantially near note 21 and drive arm assemblies 225 substantially near notes 51, 69, and 88. The shaft rotators 250 of the bass and treble hammer stopper systems 200A may be actuated in unison or independently of each other for silent or acoustic play of the respective piano sections.

Figure 10:
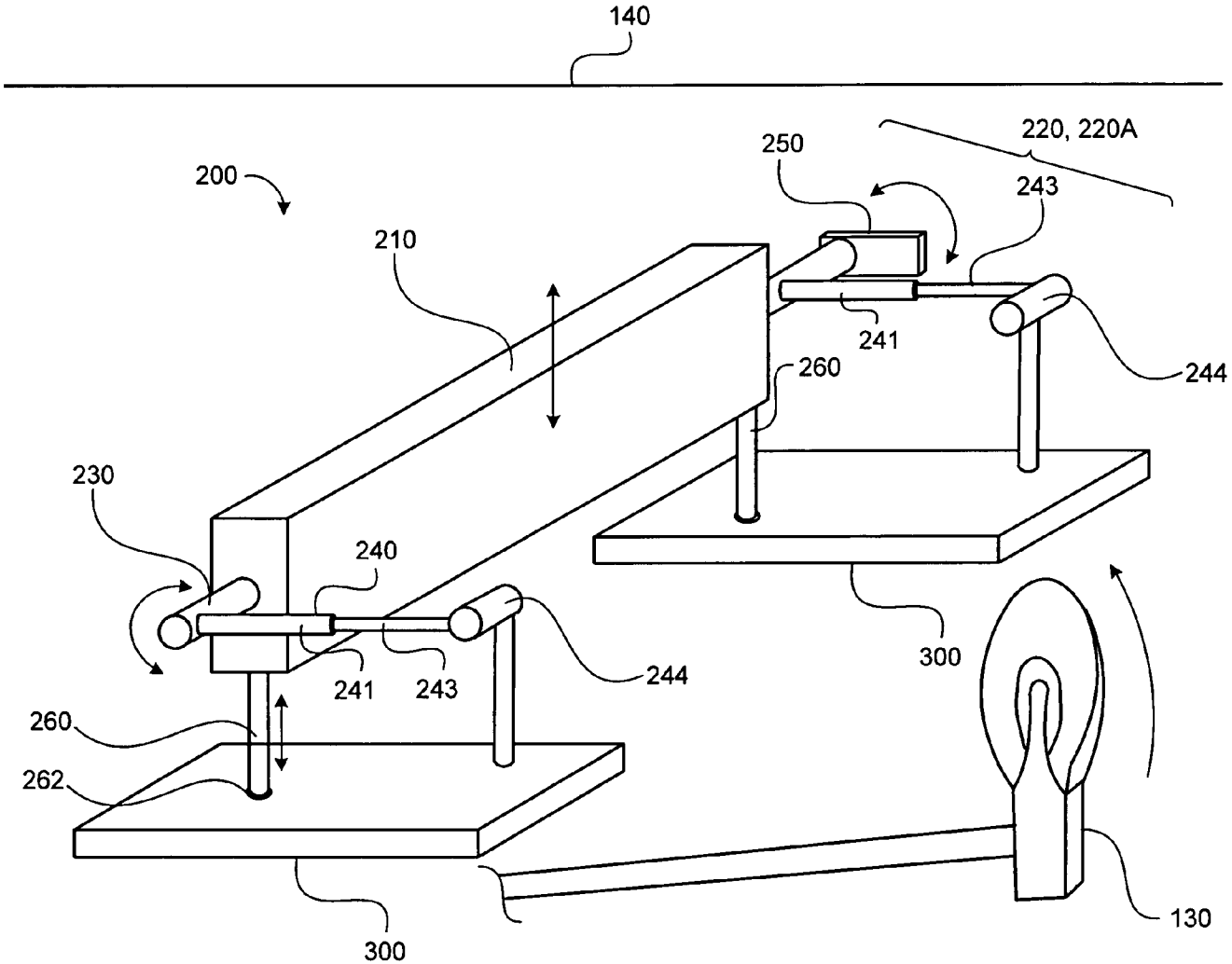
FIG. 10 is a perspective view of a hammer stopper system for a grand piano.
Figure 11:
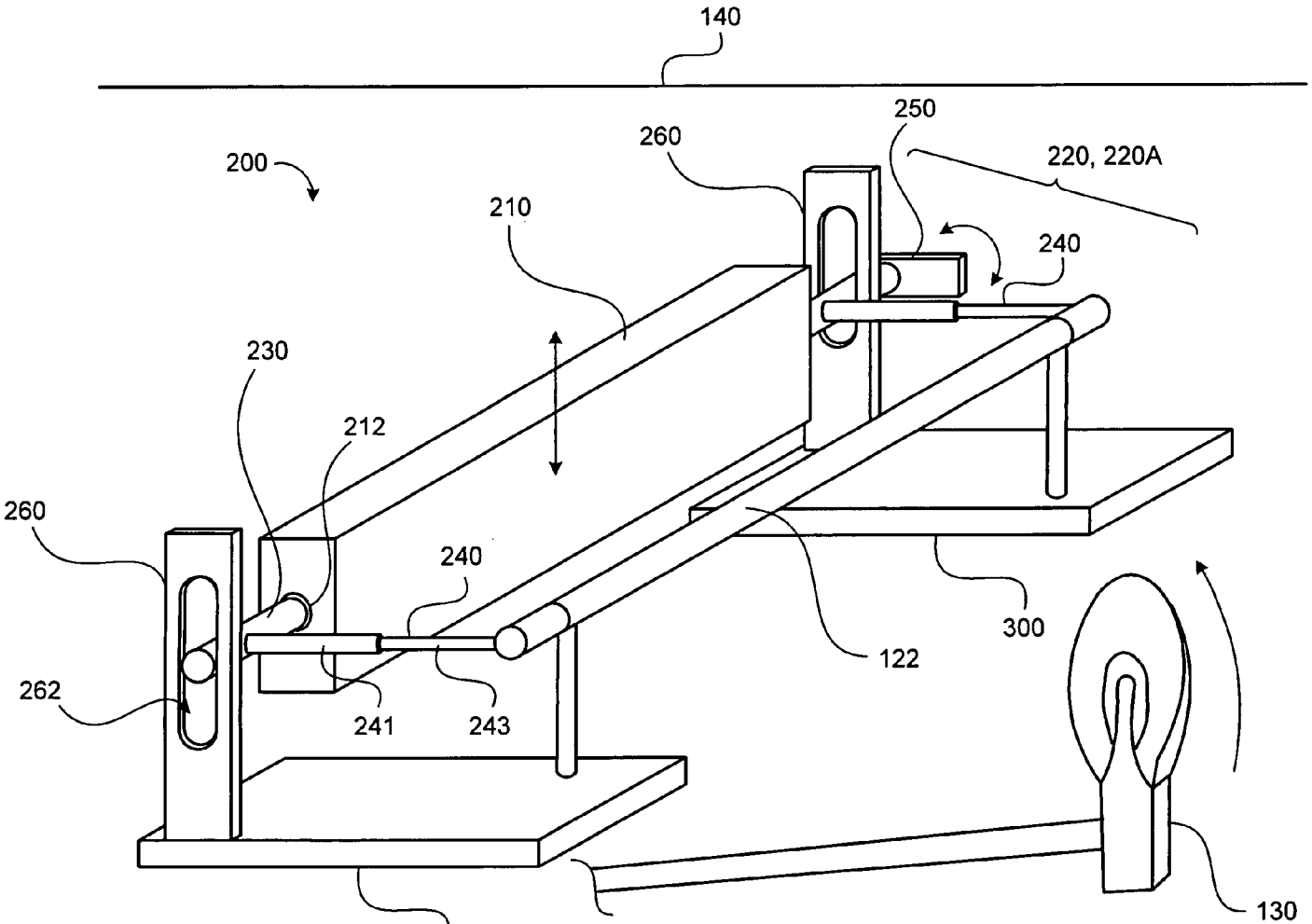
FIG. 11 is a perspective view of a hammer stopper system for a grand piano.

In some implementations, as shown in FIGS. 4-9, the drive arm 240 defines a guide way 242 (e.g., slot or groove) configured to receive the drive arm fulcrum 244. Rotation of the drive shaft 230 in the clockwise or counter-clockwise direction causes the drive arm 240 to pivot and slide on the drive arm fulcrum 244 to move the blocking rail 210 between its first and second positions. In some implementations, as shown in FIGS. 10 and 11, the drive arm 240 includes first and second portions 241, 243 slidably engaging one another (e.g., telescopically). The first drive arm portion 241 is attached to the drive shaft 230 and the second drive arm portion 243 is pivotally attached to the drive arm fulcrum 244. Rotation of the drive shaft 230 in the clockwise or counter-clockwise direction causes the drive arm 240 to pivot on and telescope to and from the drive arm fulcrum 244 to move the blocking rail 210 between its first and second positions.

In the examples shown in FIGS. 4-10, the travel guide 260 is configured as a guide shaft 260 attached to the blocking rail 210 and received through a guide way 262 (e.g., aperture or groove) defined by the support member 300 (e.g., bracket). Similarly, the guide shaft 260 may be attached to the support member 300 and received through a guide way 262 defined by the blocking rail 210. In the example shown in FIG. 11, the travel guide 260 is attached to a support member 300 and defines a guide way 262 (e.g., slot or groove) for receiving the drive shaft 230, which is disposed on or through the blocking rail 210. The travel guide 260 allows rotation of the drive shaft 230 and is disposed at each end of the blocking rail 210 for guiding movement of the blocking rail 210. In the example shown in FIG. 7, the travel guide 260 includes a spring 266 for biasing the blocking rail 210 toward its second position for silent play.

Figure 12:
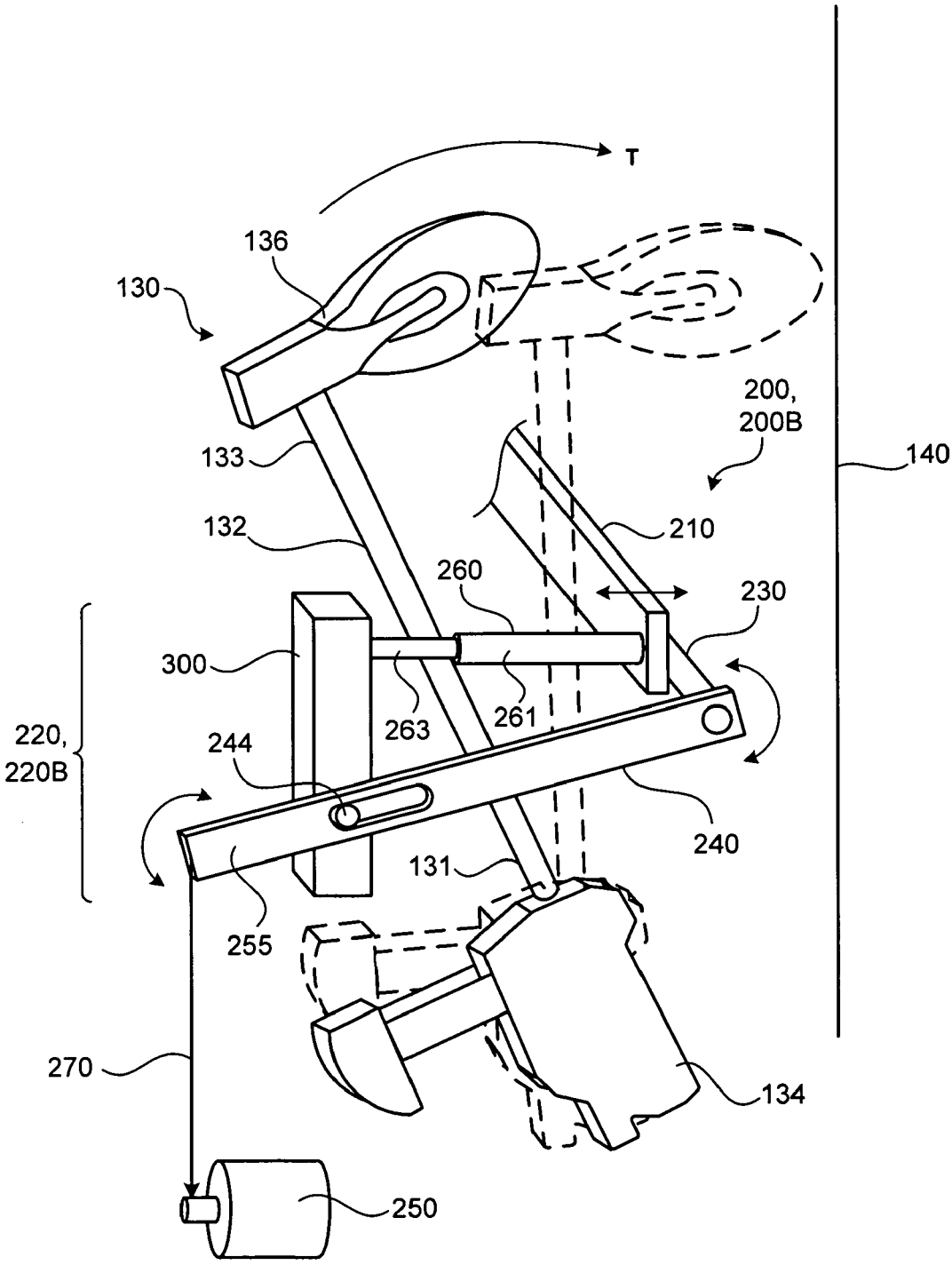
FIG. 12 is a perspective view of a hammer stopper system for an upright piano.

FIGS. 3 and 12 illustrate implementations of a hammer stopper system 200, 200B for an upright piano 100B. The hammer stopper system 200B includes a blocking rail 210 disposed between the hammers 130 and the strings 140, and a rail actuator assembly 220B configured to move the blocking rail 210 between a first position, allowing unobstructed movement of the hammers 130, and a second position blocking at least one hammer 130 from striking its corresponding string(s) 140. The rail actuator assembly 220B moves the blocking rail 210 to the first position for acoustic play and to the second position for silent play. In the example shown in FIG. 12, the rail actuator assembly 220B includes a drive shaft 230 disposed along the blocking rail 210. The drive shaft 230 may be a rigid shaft (e.g., bar stock) or a flexible shaft, which transmits rotation and torque while remaining flexible to bend along any curves of the blocking rail 210. In some examples, the drive shaft 230 is routed through a channel 212 defined by the blocking rail 210. The rail actuator assembly 220 includes at least one drive arm 240 attached to the drive shaft 230 and slidably coupled to a support member 300. Rotation of the drive shaft 230 causes rotation of the drive arm 240 which engages a drive arm fulcrum 244 to move the blocking rail 210 between its first and second positions. The drive arm fulcrum 244 may be disposed on a support member 300 (e.g., bracket). The rail actuator assembly 220B includes a drive arm rotator 255 configured to pivot the drive arm 240 with respect to the drive fulcrum 244.

The rail actuator assembly 220B includes one or more travel guides 260 configured to guide movement of the blocking rail 210 along a travel path among its first and second positions. As with the grand piano system, the travel path may be a substantially linear or non-linear (e.g., parabolic). In the example shown in FIG. 12, the travel guide 260 includes first and second portions 261, 263 slidably engaging one another (e.g., telescopically) and providing a substantially linear travel path for the blocking rail 210. The first travel guide portion 261 is attached to the blocking rail 210 and the second travel guide portion 263 is attached to the support member 300.

Referring again to FIGS. 1 and 3, in some implementations, the piano 100A, 100B includes a mode selection switch 150 in communication with the rail actuator assembly 220, 220A, 220B (e.g., in communication with the shaft rotator 250 or the drive arm rotator 255). A user may toggle the mode switch 150 to alter the play mode between acoustic play and silent play, and the drive shaft 230 is rotated to the corresponding position of the play mode. In some implementations, the mode selection switch 150 is coupled to a wire or linkage 270 coupled to the rail actuator assembly 220 (e.g., via the shaft rotator 250 or the drive arm rotator 255). In other implementations, the mode selection switch 150 may be housed by a controller unit 300 disposed on the piano 100A, 100B. The controller 300 may include circuitry that controls switching between play modes (e.g. via the rail actuator assembly 220, 220A, 220B), storing play information (e.g. MIDI files), electronic play calibration, tone adjustment, and trouble shooting, inter alia. The controller 300 may be in communication with the drive shaft rotator 250 or the drive arm rotator 255 actuating the rail actuator assembly 220.

Figure 13:
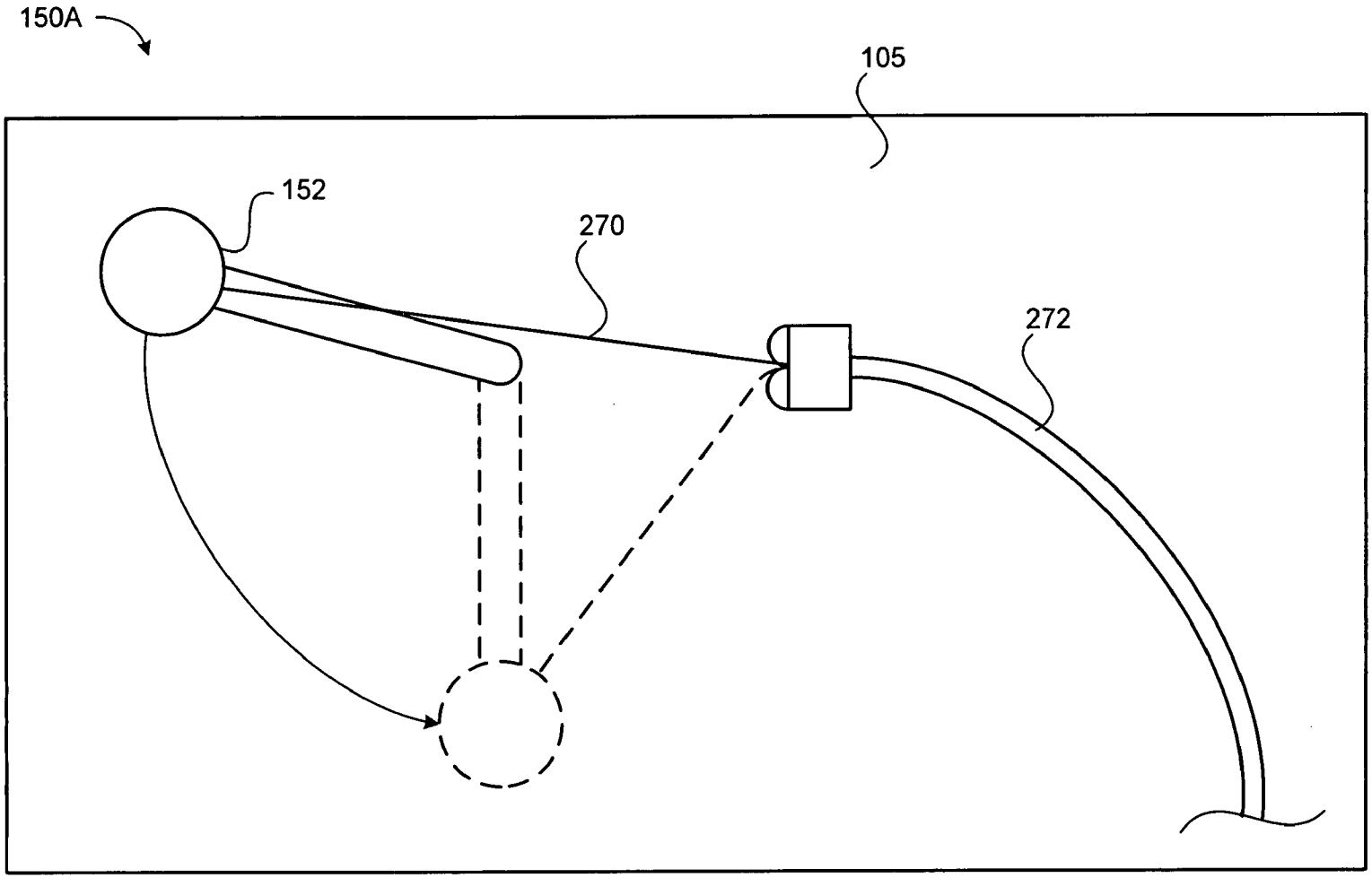
FIG. 13 is a side view of a mode selection switch.

The piano 100A, 100B may include a mode selection switch 150A, an example of which is shown in FIG. 13, disposed on a portion of a piano case 105 of the piano 100A, 100B. For example, the mode selection switch 150A may be located on the piano case 105 below the keys 110 (e.g., on a vertical or horizontal panel). The mode selection switch 150A includes a handle 152 pivotable between first and second positions. The wire 270 is attached to the handle 152 and guided through a sheath 272 to the shaft rotator 250. In its first position, the mode selection switch 150A causes the rail actuator assembly 220 of the hammer stopper system 200 to hold the blocking rail 210 in its first position allowing unobstructed movement of piano hammers 130. In its second position, the mode selection switch 150A causes the rail actuator assembly 220 to hold the blocking rail 210 in its second position blocking at least one piano hammer 130 from striking any corresponding strings 140. The handle 152 may be releasably held in its first and second positions be a spring, magnet, releasable fastener (e.g., hook and loop fasteners), etc. In the example of a spring, a spring 266 may be attached to the handle and/or the rail actuator assembly 220. In some examples, the handle 152 may be releasably held in its first and second positions by a detent, groove, or feature defined by the piano case 105 or a bracket holding the handle 152.

In some implementations, the silent play mode is engaged by pressing a mode selection pedal 160 (e.g., by pressing the pedal 160 downward and then rotating it laterally to a lockably engaged position to hold the silent play mode). The mode selection pedal 160 is coupled to a cable or linkage 270 coupled to the rail actuator assembly 220 (e.g., via the shaft rotator 250 or the drive arm rotator 255). In some cases, the mode selection pedal 160 engages the mode selection switch 150 when moved to its engaged position. The mode selection pedal 160 may be held in its engaged position, e.g., by a magnet, detent in a piano casing, a bracket, etc.

A number of implementations have been described. Nevertheless, it will be understood that various modifications may be made without departing from the spirit and scope of the disclosure. For example, referring to FIG. 4, the spring 266 may instead be disposed, e.g. between the support member 300 and the blocking rail 210, for biasing the blocking rail 210 toward its first position for acoustic play, or an extension spring may instead, or also, be employed. Accordingly, other implementations are within the scope of the following claims.

What is claimed is:

1. A piano hammer stopper system comprising:

a blocking rail movable between a first position, allowing unobstructed movement of piano hammers, and a second position blocking at least one piano hammer from striking any corresponding strings;

a drive shaft rotatably coupled to the blocking rail;

a drive arm attached to the drive shaft and engaging a drive fulcrum; and a travel guide directing movement of the blocking rail between its first and second positions;

wherein rotation of the drive shaft rotated the drive arm to engage the drive fulcrum for moving the blocking rail between its first and second positions.

2. The piano hammer stopper system of claim 1, wherein the drive arm defines a slot configured to receive the drive fulcrum, the drive arm pivoting about and sliding with respect to the received drive fulcrum.

3. The piano hammer stopper system of claim 1, wherein the drive arm comprises first and second drive arm portions slidably engaging one another, the first drive arm portion attached to the blocking rail, and the second drive arm portion pivotally coupled to the drive fulcrum.

4. The piano hammer stopper system of claim 1, wherein the travel guide comprises a guide shaft received by a guide way, the guide shaft attached to the blocking rail and at least one support member of the hammer stopper system.

5. The piano hammer stopper system of claim 1, wherein the travel guide defines a guide way configured to receive the drive shaft.

6. The piano hammer stopper system of claim 1, wherein the blocking rail is biased toward one of its first and second positions.

7. The piano hammer stopper system of claim 1, wherein the drive shaft is flexible for following the general shape of the blocking rail.

8. The piano hammer stopper system of claim 1, further comprising a shaft rotator coupled to the drive shaft for rotating the drive shaft.

9. The piano hammer stopper system of claim 8, wherein the shaft rotator comprises a lever defining an aperture for a receiving a pivot, rotation of the lever about the pivot moving the drive shaft vertically with respect to the pivot and rotating the drive shaft with respect to the blocking rail.

10. The piano hammer stopper system of claim 1, further comprising an arm rotator coupled to the drive arm for pivoting the drive arm with respect to the drive fulcrum.

11. A piano playable in an acoustic mode and a silent mode, the piano comprising:

a series of keys;

a series of key actions, each key action actuated by depression of a corresponding key;

a series of rotatable hammers, each defining a forward throw direction and having at least one corresponding string, the hammers being driven by corresponding key actions transferring forces from corresponding keys; and a hammer stopper system comprising:

a blocking rail movable between a first position, allowing unobstructed movement of piano hammers, and a second position, blocking at least one piano hammer from striking any corresponding strings; and a rail actuator assembly coupled to the blocking rail, the rail actuator assembly comprising:

a drive shaft rotatably coupled to the blocking rail;

a drive arm attached to the drive shaft and engaging a drive fulcrum; and a travel guide directing movement of the blocking rail between its first and second positions;

wherein rotation of the drive shaft rotates the drive arm to engage the drive fulcrum for moving the blocking rail between its first and second positions.

12. The piano of claim 11, wherein the drive arm defines a slot configured to the receive the drive fulcrum, the drive arm pivoting about and sliding with respect to the received drive fulcrum.

13. The piano of claim 11, wherein the drive arm comprises first and second drive arm portions slidably engaging one another, the first drive arm portion attached to the blocking rail, and the second drive arm portion pivotally coupled to the drive fulcrum.

14. The piano of claim 11, wherein the travel guide comprises a guide shaft received by a guide way, the guide shaft attached to the blocking rail and at least one support member of the hammer stopper system.

15. The piano of claim 11, wherein the travel guide defines a guide way configured to receive the drive shaft.

16. The piano of claim 11, wherein the blocking rail is biased toward one of its first and second positions.

17. The piano of claim 11, wherein the drive shaft is flexible for following the shape of the blocking rail.

18. The piano of claim 11, further comprising a shaft rotator coupled to the drive shaft for rotating the drive shaft.

19. The piano of claim 18, wherein the shaft rotator comprises a lever defining an aperture for a receiving a pivot, rotation of the lever about the pivot moving the drive shaft vertically with respect to the pivot and rotating the drive shaft with respect to the blocking rail.

20. The piano of claim 11, further comprising an arm rotator coupled to the drive arm for pivoting the drive arm with respect to the drive fulcrum.

21. The piano of claim 11, further comprising a mode selection switch in communication with the rail actuator assembly and controlling movement of the blocking rail among the first and second positions.

22. The piano of claim 21, wherein the mode selection switch is engaged by a pedal of the piano.

23. The piano of claim 11, further comprising a controller in communication with the rail actuator assembly and controlling switching among the acoustic play mode and the silent play mode.

* * * * *

UNITED STATES PATENT AND TRADEMARK OFFICE

CERTIFICATE OF CORRECTION

PATENT NO. : 8,148,620 B2
APPLICATION NO. : 12/429485
DATED : April 3, 2012
INVENTOR(S) : Scott Jones It is certified that error appears in the above-identified patent and that said Letters Patent is hereby corrected as shown below:

Col. 8, line 19, in Claim 1, delete "rotated" and insert -- rotates --, therefor.

Col. 9, line 14, in Claim 12, delete "to the" and insert -- to --, therefor.

Signed and Sealed this
Twenty-ninth Day of May, 2012

David J. Kappos

David J. Kappos
*Director of the United States Patent and Trademark Office*